United States Patent [19]

Hanna

[11] 4,091,321

[45] May 23, 1978

[54] LOW VOLTAGE REFERENCE

[75] Inventor: John Edward Hanna, Scottsdale, Ariz.

[73] Assignee: Motorola Inc., Schaumburg, Ill.

[21] Appl. No.: 748,580

[22] Filed: Dec. 8, 1976

[51] Int. Cl.[2] ..... G05F 3/08

[52] U.S. Cl. ..... 323/19; 323/22 T

[58] Field of Search ..... 323/1, 4, 16, 19, 22 T

[56] References Cited

U.S. PATENT DOCUMENTS

| | | | |
|---|---|---|---|
| 3,617,859 | 11/1971 | Dobkin et al. | 323/4 |
| 3,781,648 | 12/1973 | Owens | 323/4 |
| 3,887,863 | 6/1975 | Brokaw | 323/19 |
| 3,893,018 | 7/1975 | Marley | 323/19 |
| 3,908,162 | 9/1975 | Marley et al. | 323/19 |

OTHER PUBLICATIONS

Meijer et al., "An Integrated Bandgap Reference," IEEE Journal of Solid-State Circuits, vol. SC-11, No. 3, Jun. 1976, pp. 403-406.

Widlar, "New Developments in IC Voltage Regulators," IEEE Journal of Solid-State Circuits, vol. Sc-6, No. 1, Feb. 1971, pp. 2-7.

*Primary Examiner*—A. D. Pellinen

*Attorney, Agent, or Firm*—Joe E. Barbee

[57] ABSTRACT

A temperature compensated low voltage reference that produces an output voltage less than the silicon band-gap voltage. The low voltage reference includes at least a first and a second transistor for providing a voltage independent of variations in the collector power supply and at least a third transistor for developing a voltage that is a fractional value of the base-to-emitter voltage drop of a transistor. The at least a third transistor for developing is coupled with the at least a first and a second transistor for providing. The low voltage reference also includes an output transistor for providing an output voltage. The output transistor is controlled by the voltage provided by the at least a first and a second transistor for providing so that the output voltage is essentially insensitive to temperature variations and is a lower value than the silicon band-gap voltage.

9 Claims, 4 Drawing Figures

LOW VOLTAGE REFERENCE

BACKGROUND OF THE INVENTION

This invention relates generally to electronic reference circuits and, more particularly, to a low voltage reference source capable of providing an output voltage which is insensitive to temperature variations and to variations in the power supplied to the reference circuit. The output voltage can be lower than the silicon band-gap voltage. The reference circuit can also be adapted in accordance with this invention to provide a current reference.

Many circuits exist for providing voltage regulation or voltage references. However, many of these prior art circuits suffer from poor temperature compensation and are therefore not suitable for use in logic circuits requiring closely regulated power sources. In a solid state voltage regulator not having temperature compensation, the output will tend to vary with changes in ambient temperature. In most cases, the output variation is due to the negative temperature coefficient associated with the base-to-emitter junction voltage of transistors used in the regulator. As the temperature increases, the base-to-emitter voltage drop, $V_{BE}$, decreases and conversely with a decrease in temperature the $V_{BE}$ increases. In the past, voltage references or regulators have been made temperature independent by combining a positive temperature coefficient component with the negative temperature coefficient voltage of a base-to-emitter junction so that the two different temperature coefficients cancel each other out and, therefore, provide an output that is independent of temperature.

One scheme for obtaining a positive temperature coefficient signal is by taking the difference of the emitter-to-base voltage from two different transistors that are operating at two different current levels. Such a scheme was used on the regulator in U.S. Pat. No. 3,617,859, which was issued to Robert C. Dobkin, et al. The reference provided in the aforementioned U.S. Patent is commonly called a band-gap reference since the reference voltage provided is equal to the band-gap energy of the emitter-to-base junction voltage, $V_{GO}$. In order to achieve lower voltages than $V_{GO}$ the output of the reference must be attenuated such as by a voltage divider network. Then the attenuated voltage is usually buffered by a unity gain-amplifier. However, such a scheme is cumbersome and requires additional circuitry to attenuate and to isolate the reference voltage.

Due to the tight logic level tolerances on many state-of-the-art logic circuits it is desirable to have a low voltage that is independent of temperature and other variations. This is more so the case when low voltage power supplies are used as a voltage source for the logic circuit, e.g., in portable equipment which is powered by dry cell batteries.

Accordingly, one of the objects of the present invention is to provide an output voltage or current having a zero or adjustable temperature coefficient at a voltage less than the silicon band-gap voltage.

Another object of the invention is to provide a reference voltage or a reference current which is insensitive to temperature and to variations in the main power supply and yet produces an output voltage less than the silicon band-gap voltage.

SUMMARY OF THE INVENTION

In carrying out the above and other objects of the invention in one form, there is provided an improved temperature compensated reference source circuit. One embodiment of the invention has a means for providing a voltage independent of variations in the main power supply and means for developing a voltage that is a fractional value of a base-to-emitter voltage drop of a transistor. The means for developing is coupled with the means for providing. The reference circuit also has output means for providing an output voltage. The output means is controlled by the voltage provided by the means for providing so that the output voltage is substantially insensitive to temperature variations and can be lower than the silicon band-gap voltage. The reference circuit can also be adapted in accordance with the invention to provide a current reference source.

The subject matter which is regarded as the instant invention is set forth in the appended claims. The invention itself, however, together with further objects and advantages thereof, may be better understood by referring to the following detailed description taken in conjunction with the accompanying drawings.

The exemplifications set out herein illustrate the preferred embodiments of the invention in one form thereof, and such exemplifications are not to be construed as limiting in any manner.

DESCRIPTION OF THE PREFERRED EMBODIMENTS

Figure 1:
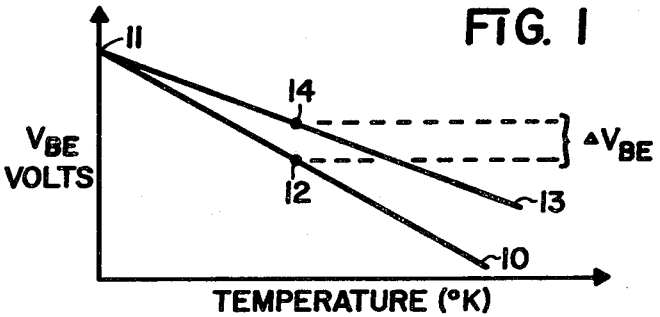
FIG. 1 is a graph illustrating the relationship between the base-to-emitter voltage drop versus temperature.

FIG. 1 is a graph illustrating the base-to-emitter junction voltage drop of a typical silicon transistor versus temperature. The base-to-emitter voltage drop is plotted along the ordinate in volts while the temperature is plotted in degrees Kelvin along the abscissa. Curve 10 is a plot for a typical silicon transistor operating at a predetermined current level. At 0° Kelvin the base-to-emitter voltage would be at its maximum, point 11, which is theoretically 1.205 volts. Point 12 along curve 10 could be a typical operating ambient temperature of a transistor such as for instance 300° Kelvin. It is well known that as current flow through a transistor increases its base-to-emitter voltage also increases. This known fact can be used to obtain an apparent positive temperature coefficient. Curve 13 is a plot of a typical transistor operating at a higher current level than operating at on curve 10. Even though curve 13 illustrates operation at a higher current level, at 0° Kelvin its band-gap voltage is still equal to the voltage at point 11. However, at a typical ambient operating temperature, i.e., 300° K, its base-to-emitter voltage would be plotted at point 14. Accordingly, if the current flow of a transistor operating at point 12 is increased, the transistor's base-to-emitter voltage drop would also increase as illustrated by point 14. If two similar transistors, such as on an integrated circuit chip, are operating at the same temperature but at different current levels their base-to-emitter junction voltage would be different and could correspond to a $\Delta V_{BE}$, such as illustrated, as a difference between the points 12 and 14 of the graph of FIG. 1. The use of such a difference to appear as an apparent positive temperature coefficient will be explained hereinafter. The voltage which is plotted along curves 10 and 13 can be equated to the silicon band-gap voltage which is the difference in energy between the conduction band and the valence band of the semiconductor material.

Figure 2:
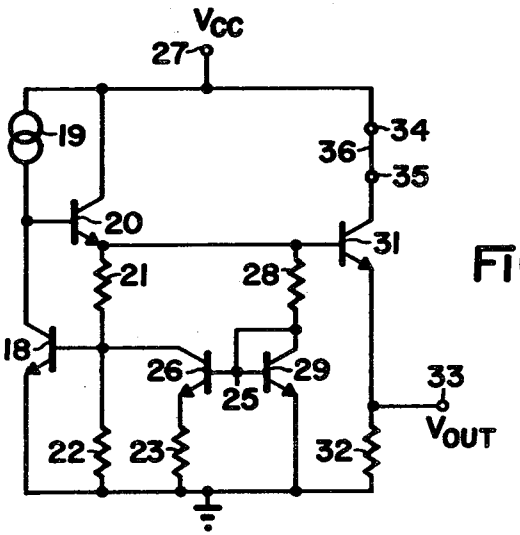
FIG. 2 illustrates in schematic form one embodiment of the invention.

Referring to FIG. 2 now, there is illustrated a simplified schematic of a circuit that can produce an output voltage lower than the silicon band-gap voltage. The output voltage is substantially fully temperature compensated. A transistor 18 has its collector connected to a current source 19. The collector is also connected to the base of a transistor 20. The collector of transistor 20 is connected to the main power supply, $V_{cc}$, at terminal 27 while its emitter is connected to a resistor 21. Resistor 21 is also connected to the base of transistor 18, to another resistor 22, and to the collector of a transistor 26. Transistor 26 has an emitter connected to a resistor 23. The voltage developed across resistor 22 will be equivalent to the base-to-emitter voltage drop of transistor 18 since the two are in parallel. This voltage drop establishes the current flowing through resistor 22. Such current also flows through resistor 21. However, resistor 21 also has a current flowing through it which flows through transistor 26 and resistor 23. Therefore, the current flowing through resistor 21 is the sum of the currents flowing through resistor 22 and resistor 23. It should be noted that the voltage developed across resistor 23 will have an apparent positive temperature coefficient since it is the difference between the base-to-emitter voltage drops of transistors 26 and 29 which are operating at different current levels. Accordingly, the voltage developed across resistor 21 can be expressed as $$V_{R21} = V_{BE18}\frac{R21}{R22} + \Delta V_{BE}\frac{R21}{R23}$$

where $V_{R21}$ is a voltage developed across resistor 21; $V_{BE18}$ is the base-to-emitter voltage drop of transistor 18; $R_{21}$, $R_{22}$ and $R_{23}$ is the ohmic value of each respective resistor 21, 22 and 23; and $\Delta V_{BE}$ is the difference between the base-to-emitter voltage drop of transistor 26 and 29. The current through transistor 29 is established by resistor 28 connected between the emitter of transistor 20 and node 25 to which are also connected the collector and base of transistor 29 and the base of transistor 26.

It will now be appreciated that the voltage across resistor 21 can be adjusted not only to a zero temperature coefficient but to either a positive or a negative temperature coefficient by the choice of the ratio of ($V_{BE18}$/R22) to ($\Delta V_{BE/R23}$). It should be noted that the voltage developed at the emitter of transistor 20 is equal to the voltage drop across resistor 21 plus the base-to-emitter voltage drop of transistor 18.

The emitter of transistor 20 is connected to the base of a transistor 31 and to a resistor 28. Resistor 28 cooperates with transistor 29 to provide a bias voltage for transistor 26. Transistor 29 has its base-to-collector connected together to appear electrically as a diode. Transistor 31 has a resistor 32 connected to its emitter to which is also connected a terminal 33 which forms an output voltage terminal. Now, it will be recognized by those persons skilled in the art that the voltage at the emitter of transistor 31 is equal to the voltage at the emitter of transistor 20 minus the base-to-emitter voltage drop of transistor 31. Or, the equation for the voltage at the emitter of transistor 31 can be written as follows;

$$V_{E31} = V_{BE18} + V_{R21} - V_{BE31}.$$

Now, if $V_{BE18} = V_{BE31}$ these two terms cancel each other out in the above equation thus leaving the voltage at the emitter of transistor 31 equal to the voltage drop across resistor 21. As noted hereinbefore, the voltage drop across resistor 21 can be made independent of temperature. It should also be noted that the voltage drop across resistor 28 is equal to the emitter voltage at transistor 20 minus the $V_{BE}$ drop of transistor 29. Now, once again, if the base-to-emitter voltage drop of transistor 29 equals the base-to-emitter voltage drop of transistor 18 then the voltage drop across resistor 28 will equal the voltage drop across resistor 21. Thus, the currents through resistors 28 and 32 will track over temperature and depend only on the temperature coefficient of the resistors. Therefore, the current flowing through transistor 31 can be made independent of temperature since the same current flows through resistor 32.

The magnitude of the voltage appearing at terminal 33 is then approximately equal to the voltage drop across resistor 21 and can be adjusted to almost any desired value by the selection of resistor 21. It will be appreciated that by proper selection of resistor 21 the voltage at output terminal 33 can be adjusted to less than the silicon band-gap voltage. Also, it should be noted that $\Delta V_{BE}$, resistor 22 or resistor 23 can be selected independently and still achieve zero temperature compensation.

The collector of transistor 31 is connected to a terminal 35. Terminal 35 is connected to terminal 34 by jumper 36. The purpose of terminals 34 and 35 and jumper 36 is to illustrate the adaptability of the circuit to provide a current reference. Jumper 36 can be removed and the circuit requiring the current reference can then be placed in series between terminals 34 and 35. Since the voltage across resistor 32 is controlled by the voltage drop across resistor 21 then the current flowing in the collector of transistor 31 is also controlled.

Figure 3:
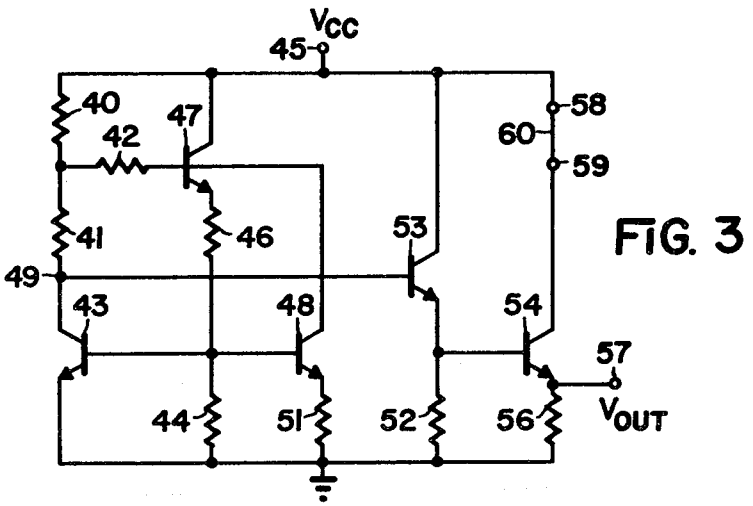
FIG. 3 is a schematic of the preferred embodiment of the invention.

FIG. 3 is a schematic of the preferred embodiment of the invention. It will be noted that the circuitry of FIG. 3 has been modified somewhat to overcome some positive feedback problems that could exist with the circuitry of FIG. 2 with some selections of $\Delta V_{BE}$. In FIG. 3, resistor 40 is connected in series with resistor 41 and to the collector of a transistor 43. A resistor 42 is connected to the junction between the resistors 40 and 41 and to the base of a transistor 47. Transistor 47 has its collector connected to main power supply terminal 45 while its emitter is connected to a resistor 46. Resistor 46 is connected to the base of transistor 43, to the base of a transistor 48, and to resistor 44. The collector of transistor 48 is connected to the base of transistor 47 while its emitter is connected to a resistor 51. The voltage drop across resistor 44 is controlled by the base-to-emitter voltage drop of transistor 43 and, of course, is equal to the base-to-emitter voltage drop of transistor 48 plus the voltage drop across resistor 51. The voltage drop across resistor 46 is then equal to the current flowing through resistor 46 times the resistance of resistor 46. The current flowing through resistor 46 is considered to be equal to the current flowing through resistor 44 since this current can be made very much larger than the base currents of transistors 43 and 48 so that the base currents can be neglected when computing the current flow through the resistors. Since the voltage across resistor 44 follows the negative temperature coefficient of the $V_{BE}$ of transistor 43, the current flowing through resistor 46 due to this $V_{BE}$ will follow the same negative temperature coefficient. The current flow through resistor 51 will be caused by the difference in voltage of the base-to-emitter drops between transistor 43 and transistor 48. Thus, the voltage developed across resistor 51 can be equated to a $\Delta V_{BE}$ which has an apparent positive temperature coefficient.

Resistor 40 establishes the current through transistor 43 while resistor 41 compensates for changes in $V_{BE}$ of transistor 43 caused by changes in collector current through transistor 43. The changes in collector current are brought about by changes in the main power supply voltage appearing at terminal 45. Accordingly, the ohmic value of resistor 41 is chosen so that variations in the voltage appearing at terminal 45 do not cause variations in the voltage appearing at node 49 at the collector of transistor 43. A feedback loop is formed by resistor 40, transistor 43, resistors 44 and 46, transistor 47, and the connection from the base of transistor 47 to the junction of resistors 40 and 41. This feedback loop helps maintain the current flow through transistor 43 at a value to allow transistor 43 to operate in its linear region. Resistor 44 senses the base-to-emitter voltage drop of transistor 43 and thereby establishes the current flow through resistor 46. It follows that the voltage drop across resistor 46 is equal to the base-to-emitter voltage drop, $V_{BE}$, of transistor 43 times the ratio of resistor 46 to resistor 44. This voltage drop across resistor 46 is selected to be a fraction of the base-to-emitter voltage of transistor 43 by setting the resistance of resistor 44 to be greater than the resistance of resistor 46.

Resistor 42 is a load resistor for transistor 48 and, therefore, develops an amplified version of the difference between the base-to-emitter voltages of transistors 43 and 48. As mentioned hereinbefore this difference in base-to-emitter voltage appears to have a positive temperature coefficient and therefore compensates for the negative temperature coefficient of the fraction of the base-to-emitter voltage of transistor 43 which appears across resistor 46 plus any effects due to variations of the current which flows through transistor 43. The value of resistors 42 and 46 are chosen so that the temperature coefficients of the voltages developed across these resistors virtually cancel and the sum of the voltages developed contributes the majority of the desired output voltage. Thus, the voltage at node 49 equals the $V_{BE}$ of transistor 43 plus the $V_{BE}$ of transistor 47 plus the sum of the voltage developed across resistors 42 and 46 minus the small correcting voltage developed across resistor 41. Node 49 is connected to the base of a transistor 53. Transistor 53 is connected between voltage terminal 45 and a resistor 52. The emitter of transistor 53 is connected to the base of a transistor 54. The collector of transistor 54 is coupled to voltage terminal 45 while the emitter of transistor 54 is connected to a resistor 56. The base-to-emitter voltage drops of transistors 53 and 54 are subtracted from the voltage appearing at node 49 to cancel the base-to-emitter voltage drops of transistors 43 and 47 thereby reducing the voltage appearing at terminal 57 to a level below the silicon band-gap voltage. The voltage output of the circuit can be taken from the emitter of 54, or if a current reference is desired, it can be taken from the terminals 58 and 59 by removing jumper 60. Of course those persons skilled in the art will realize that by taking the voltage output from the emitter of transistor 54 a relative low impedance output voltage source is provided.

Approximate value of resistors that may be used in the circuit of FIG. 3 are:

| | |
|---|---|
| Resistor 40 | 4070 ohms |
| Resistor 41 | 79 ohms |
| Resistor 42 | 8700 ohms |
| Resistor 46 | 168 ohms |
| Resistor 51 | 4700 ohms |
| Resistor 52 | 2060 ohms |
| Resistor 56 | 600 ohms |

Figure 4:
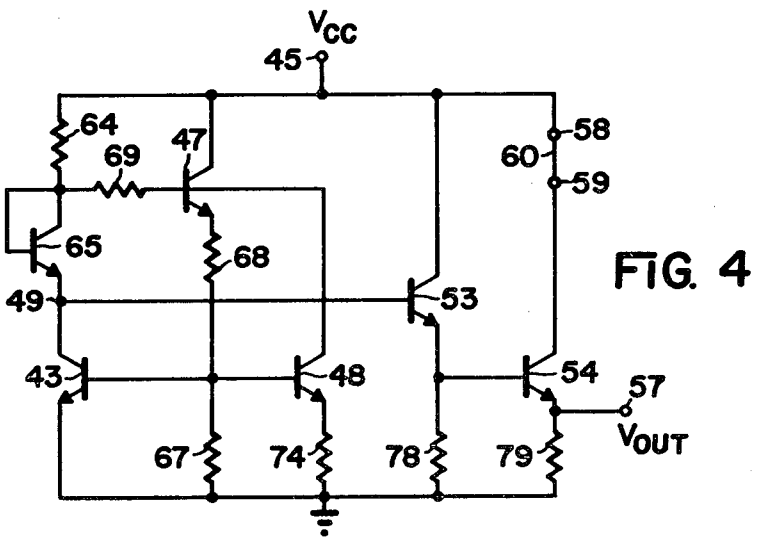
FIG. 4 is a slight variation of the embodiment of FIG. 3.

FIG. 4 is a schematic of a slightly modified version of the preferred embodiment of FIG. 3. The main difference between the schematics of FIG. 3 and FIG. 4 is that a transistor 65 has been substituted in FIG. 4 for resistor 41 of FIG. 3. The emitter of transistor 65 is connected to node 49 while the base is connected to the collector. The resistors of the circuit of FIG. 4 have different reference numbers from the resistors of FIG. 3 to indicate that the ohmic values of the resistors of FIG. 4 can be of slightly different ohmic values if desired. The operation of the circuit of FIG. 4 is substantially the same as the circuit of FIG. 3.

By now it should be appreciated that the present invention provides an output reference voltage which is lower than the silicon band-gap voltage by taking a fraction of a base-to-emitter voltage drop. Not only does the present invention allow for the output voltage to have a zero temperature coefficient but, if desired, the output voltage can have an adjustable temperature compensation. In addition, the output voltage is independent of voltage variations that may occur in the main power supply.

Consequently, while in accordance with the Patent Statutes there has been described what at present are considered to be preferred forms of this invention it will be obvious to those skilled in the art that numerous changes and modifications may be made herein without departing from the spirit and scope of the invention, and it is therefore aimed in the following claims to cover all such modifications.

What is claimed as new and is desired to secure by Letters Patents of the United States is:

1. A temperature compensated electronic reference circuit comprising: means for providing a voltage independent of variations in the main power supply, the means for providing having at least a first and a second transistor, a collector of the first transistor being coupled to a base of the second transistor and a base of the first transistor being coupled to an emitter of the second transistor; means for developing a voltage that is a fractional value of a base-to-emitter voltage drop of a transistor, the means for developing including a resistance means and a third transistor, the means for developing being coupled with the means for providing; and output means for providing an output voltage, the output means being controlled by the voltage provided by the means for providing, the output means having at least one transistor to provide a base-to-emitter voltage drop which is subtracted from the voltage provided by the means for developing, the output voltage being substantially insensitive to temperature variations and being lower than silicon band-gap voltage.

2. A temperature compensated circuit capable of providing a low reference voltage, comprising: a first circuit means connected to a main power terminal and having a transistor, feedback means coupled to the first circuit means so that at least one point in the first circuit can be maintained at a voltage which is independent from voltage variations in a main power supply, the feedback means and the first circuit means cooperating to provide a fraction of base-to-emitter voltage of the transistor; means coupled to the feedback means to provide a positive temperature coefficient signal, the positive temperature coefficient being obtained by developing a difference between a base-to-emitter voltage drop of two different transistors, the means coupled to the feedback means providing a capability of maintaining the at least one point at a voltage level having a predetermined temperature coefficient; and an output circuit coupled to the at least one point so that the output circuit is provided with current control, the output circuit being capable of providing an output voltage which is temperature compensated and is less than silicon band-gap voltage, the output circuit providing a base-to-emitter voltage drop which is subtracted from a voltage available at the at least one point to provide the output voltage.

3. A temperature compensated circuit having at least one main power supply terminal and at least one output terminal, comprising: a current source means coupled to the supply terminal; a first transistor having a base, an emitter, and a collector, the collector being coupled to the current source means; a second transistor having a base, an emitter, and a collector, the base of the second transistor being coupled to the current source means, and the collector of the second transistor being coupled to the supply terminal; a second and a third resistance being connected in series, the second resistance being coupled to the emitter of the second transistor, and the base of the first transistor being coupled to a junction formed by the second and third resistances; a third transistor having a base, an emitter, and a collector, the base of the third transistor being coupled to the junction formed by the second and third resistances, the collector of the third transistor being coupled to the base of the second transistor; a fourth resistance being coupled to the emitter of the third transistor; and a fourth transistor having a base, an emitter and a collector, the base of the fourth transistor being coupled to the collector of the first transistor, the collector of the fourth transistor being coupled to the supply terminal, the at least one output terminal being coupled to the emitter of the fourth transistor.

4. The circuit of claim 3 wherein a load can be connected between the collector of the fourth transistor and the supply terminal so that the circuit becomes a current source.

5. The circuit of claim 3 further having a fifth resistance coupled to the emitter of the fourth transistor.

6. The circuit of claim 3 further having a fifth transistor having a base, an emitter, and a collector, the collector of the fifth transistor being coupled to the supply terminal, the base and emitter of the fifth transistor being between the base of the fourth transistor and the collector of the first transistor; and a sixth resistance coupled to the emitter of the fifth transistor.

7. The circuit of claim 3 further having a seventh resistance in series between the collector of the first transistor and the current source means; and an eighth resistance coupled to a junction formed by the first and seventh resistances and to the base of the second transistor.

8. The circuit of claim 3 wherein the current source means is a resistor.

9. A temperature compensated low voltage reference capable of providing an output that is independent of temperature variations and power supply voltage variations, comprising: a first transistor having a base, an emitter, and a collector; feedback means coupled to the first transistor and to power supply terminals to maintain a voltage constant at the collector of the first transistor even though the power supply voltage varies, the feedback means cooperating with the first transistor to provide a fraction of the first transistor's base-to-emitter voltage drop; means coupled to the feedback means to provide a positive temperature coefficient thereby compensating for a negative temperature coefficient inherent in base-to-emitter voltage drop of the first transistor; and an output transistor coupled to the collector of the first transistor so that the output transistor is provided current control, the output transistor being capable of providing an output voltage lower than silicon band-gap voltage.

* * * * *